US010316565B2

(12) United States Patent
Gabl

(10) Patent No.: US 10,316,565 B2
(45) Date of Patent: Jun. 11, 2019

(54) EJECTING DEVICE AND ARRANGEMENT CONSISTING OF A PIECE OF FURNITURE AND AN EJECTING DEVICE

(71) Applicant: Julius Blum GmbH, Hoechst (AT)

(72) Inventor: Dominik Gabl, Bludenz (AT)

(73) Assignee: JULIUS BLUM GMBH, Hoechst (AT)

( * ) Notice: Subject to any disclaimer, the term of this patent is extended or adjusted under 35 U.S.C. 154(b) by 38 days.

(21) Appl. No.: 15/592,740

(22) Filed: May 11, 2017

(65) Prior Publication Data

US 2017/0247924 A1 Aug. 31, 2017

Related U.S. Application Data

(63) Continuation of application No. PCT/AT2015/000131, filed on Oct. 9, 2015.

(30) Foreign Application Priority Data

Nov. 26, 2014 (AT) ..... 855/2014

(51) Int. Cl.

| | |
|---|---|
| ***E05D 15/26*** | (2006.01) |
| ***E05F 1/10*** | (2006.01) |
| ***E05F 3/22*** | (2006.01) |
| ***E05D 15/58*** | (2006.01) |

(52) U.S. Cl.

CPC ..... *E05F 3/227* (2013.01); *E05D 15/264* (2013.01); *E05D 15/58* (2013.01); *E05F 1/1041* (2013.01);

(Continued)

(58) Field of Classification Search

CPC ..... E05D 15/264; E05D 15/58; E05F 3/227; E05F 1/1041; E05F 1/1066

See application file for complete search history.

(56) References Cited

U.S. PATENT DOCUMENTS

| | | | |
|---|---|---|---|
| 4,631,894 | A | 12/1986 | Jerila |
| 9,068,386 | B2 | 6/2015 | Ishii et al. |

(Continued)

FOREIGN PATENT DOCUMENTS

| | | |
|---|---|---|
| CN | 1475649 | 2/2004 |
| CN | 103266833 | 8/2013 |

(Continued)

OTHER PUBLICATIONS

International Search Report dated Jan. 18, 2016 in International (PCT) Application No. PCT/AT2015/000131.

(Continued)

*Primary Examiner* — Kimberley S Wright

(74) *Attorney, Agent, or Firm* — Wenderoth, Lind & Ponack, L.L.P.

(57) ABSTRACT

An ejecting device can eject a cover element movably mounted on a piece of furniture, in particular a folding door or folding/sliding door, from a closed position into an open position. The cover element can be moved at least in a first direction perpendicular to the closing plane, on which the cover element is arranged in the closed position, and in a second direction parallel to the closing plane. The ejecting device includes an energy accumulator, which is to be charged manually by a user, and an ejecting element, on which the energy accumulator acts. The energy accumulator can be charged by moving the cover element substantially in a direction parallel to the closing plane, preferably during an ongoing cover element opening process following the ejection process, particularly preferably immediately following the ejection process.

18 Claims, 13 Drawing Sheets

(52) U.S. Cl.
CPC ..... *E05F 1/1066* (2013.01); *E05Y 2201/22* (2013.01); *E05Y 2201/232* (2013.01); *E05Y 2201/426* (2013.01); *E05Y 2800/11* (2013.01); *E05Y 2900/20* (2013.01); *E05Y 2900/212* (2013.01)

(56) References Cited

U.S. PATENT DOCUMENTS

| | | | |
|---|---|---|---|
| 9,428,950 | B2 | 8/2016 | Braungart |
| 2004/0020015 | A1 | 2/2004 | Yokemura et al. |
| 2015/0008811 | A1 | 1/2015 | Ishii et al. |
| 2015/0084492 | A1 | 3/2015 | Braungart |

FOREIGN PATENT DOCUMENTS

| | | |
|---|---|---|
| CN | 104080992 | 10/2014 |
| DE | 91 05 187 | 7/1991 |
| DE | 20 2006 000 535 | 4/2006 |
| JP | 62-193075 | 12/1987 |
| JP | 7-42440 | 2/1995 |
| JP | 7-37812 | 7/1995 |
| JP | 2004-124651 | 4/2004 |
| JP | 2010-106457 | 5/2010 |
| JP | 2011-162994 | 8/2011 |
| JP | 2012-1916 | 1/2012 |
| WO | 2007/074397 | 7/2007 |
| WO | 2013/114730 | 8/2013 |
| WO | 2013/134797 | 9/2013 |
| WO | 2013/173853 | 11/2013 |

OTHER PUBLICATIONS

Search Report dated Jun. 26, 2015 in Austrian Application No. A 855/2014, with English translation.

Search Report dated Nov. 15, 2017 in Chinese Application No. 201580063985.5.

FIG. 1a
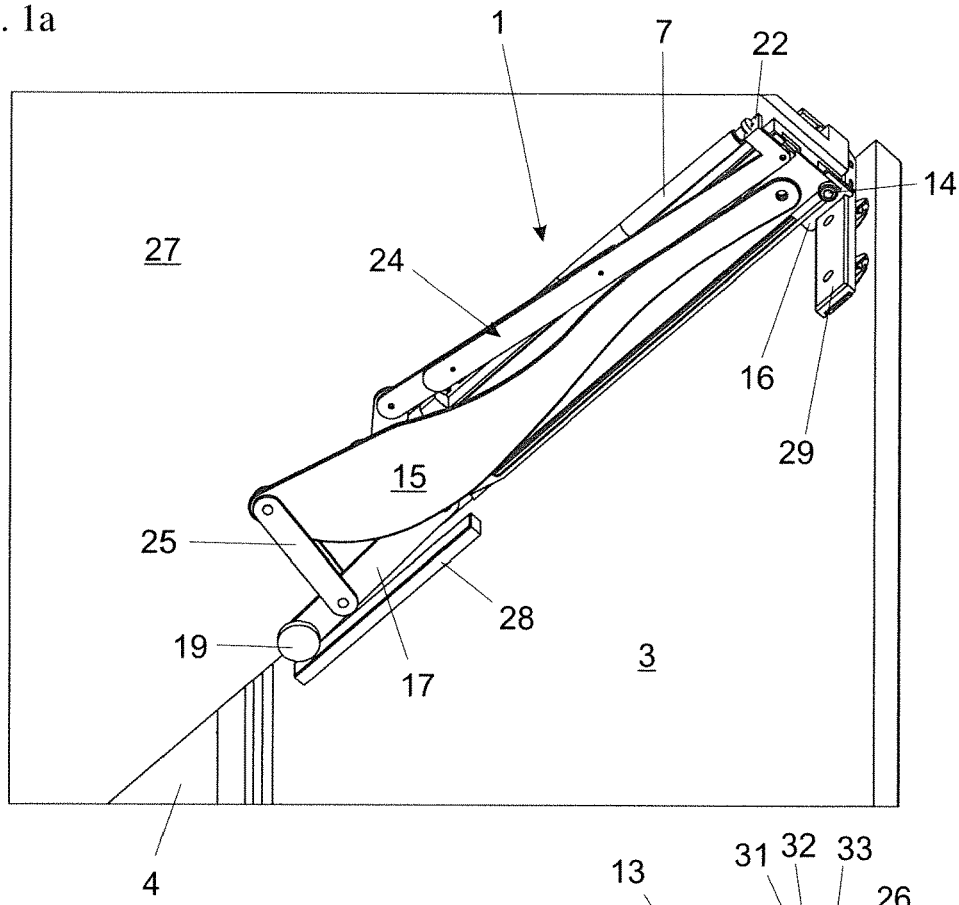
FIG. 1b
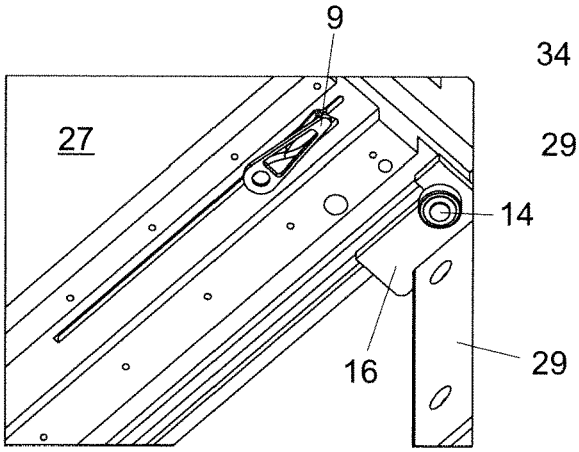
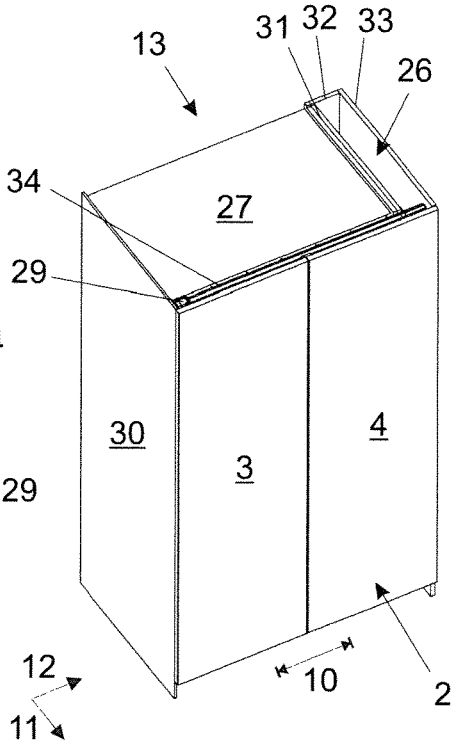
FIG. 1c

FIG. 2a
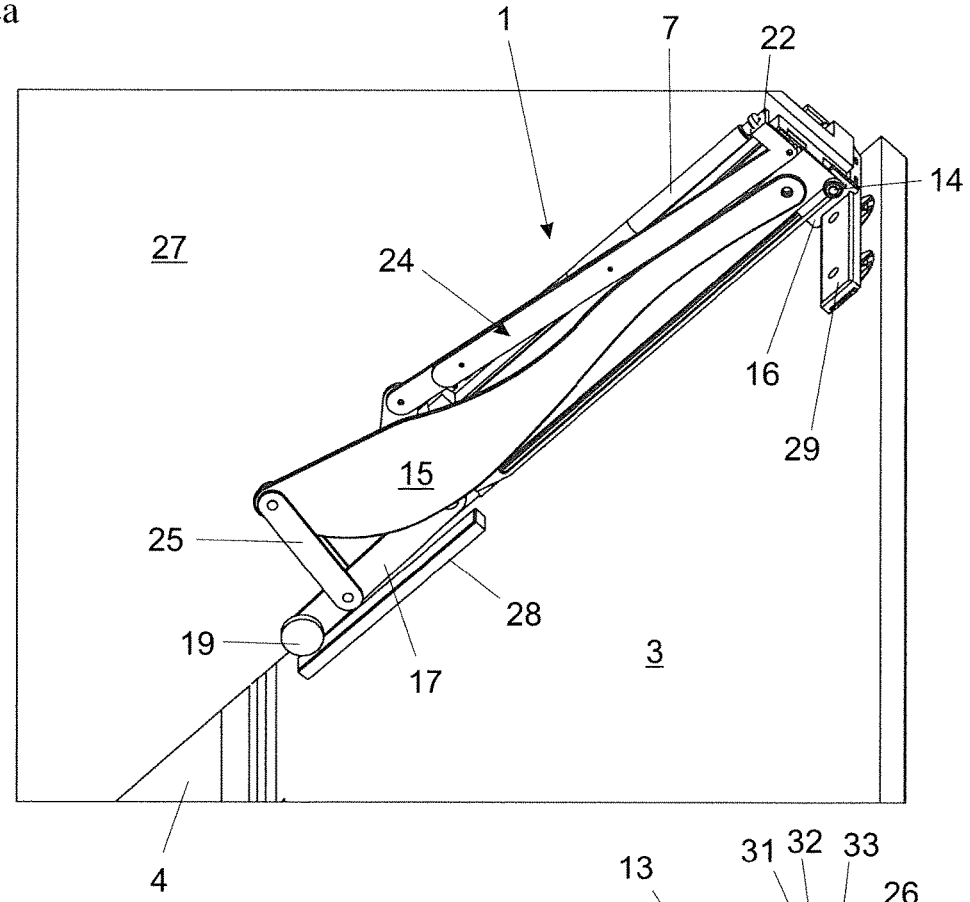
FIG. 2b
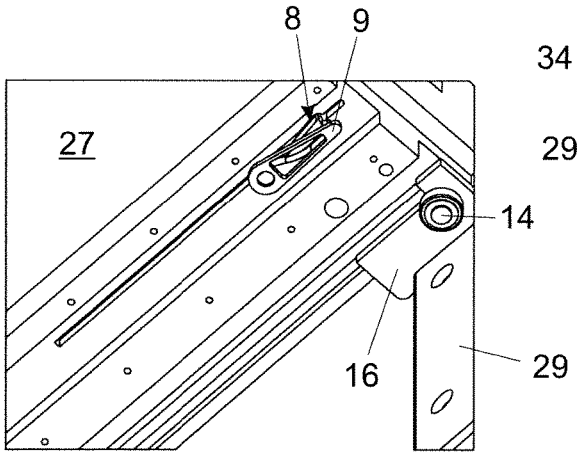
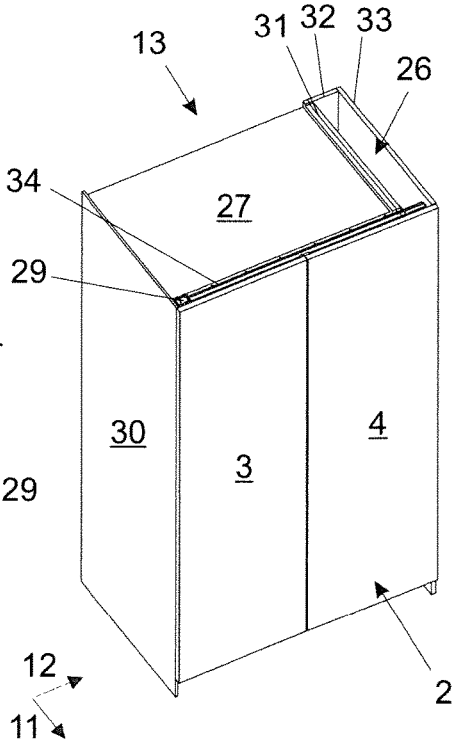
FIG. 2c

FIG. 3a
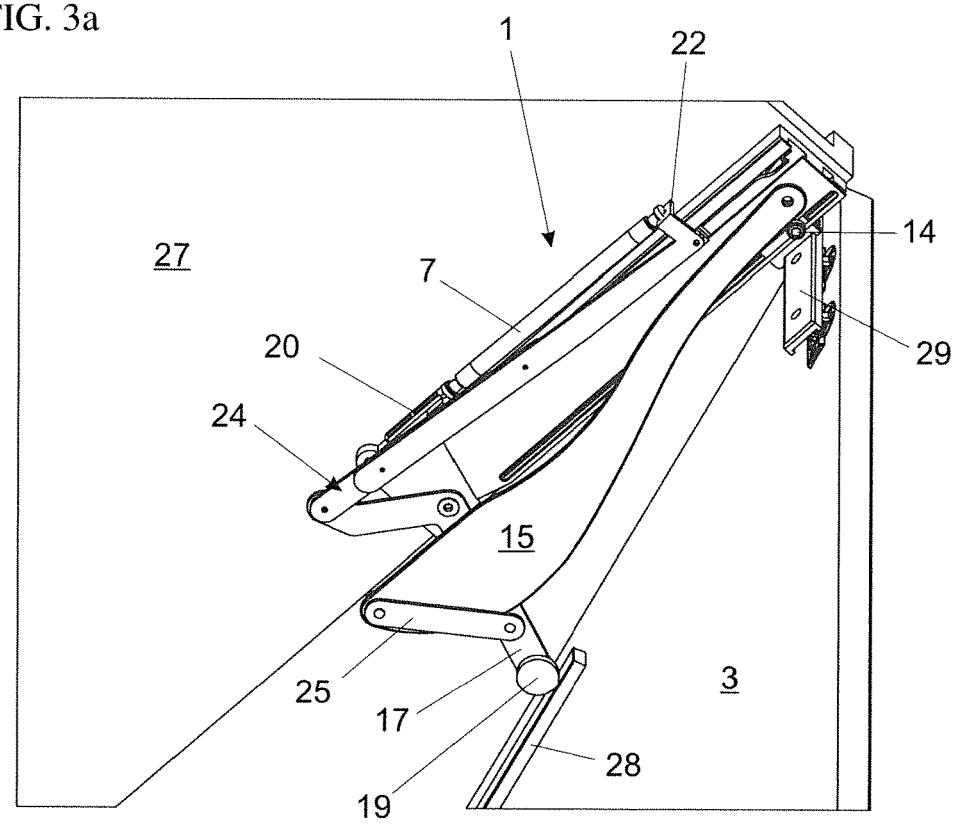
FIG. 3b
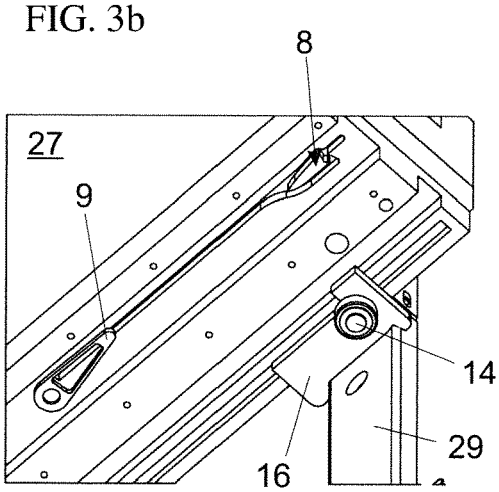
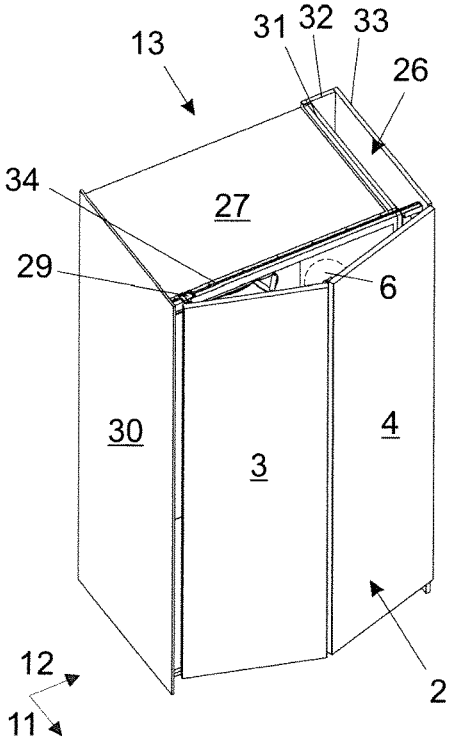
FIG. 3c

FIG. 4a
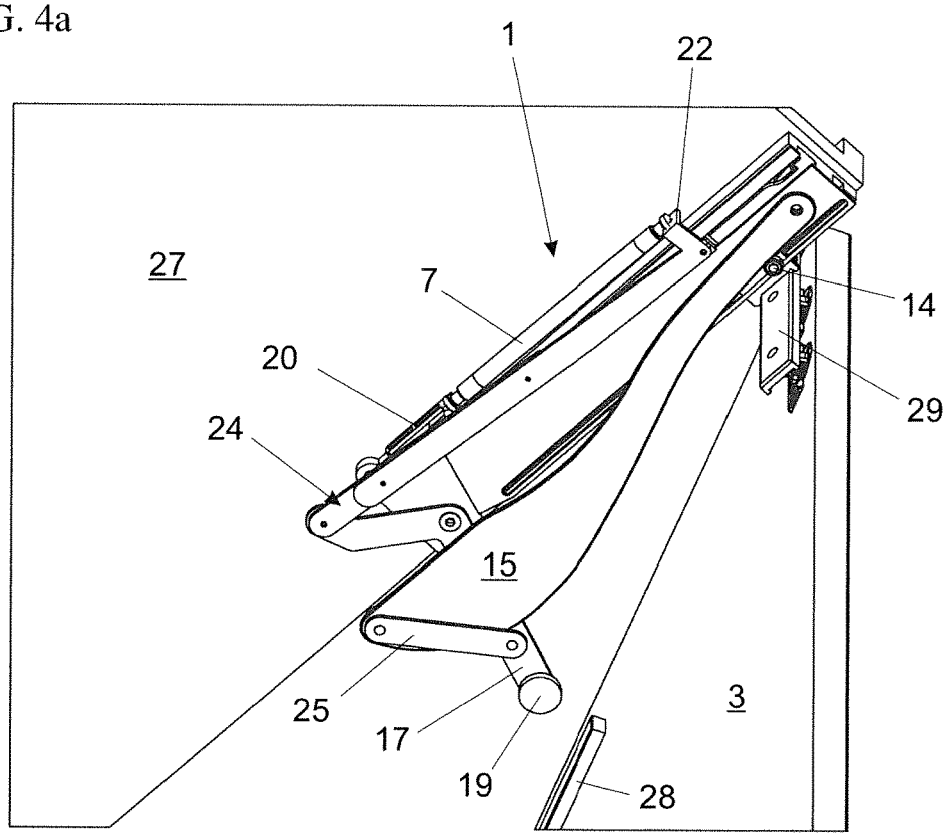
FIG. 4b
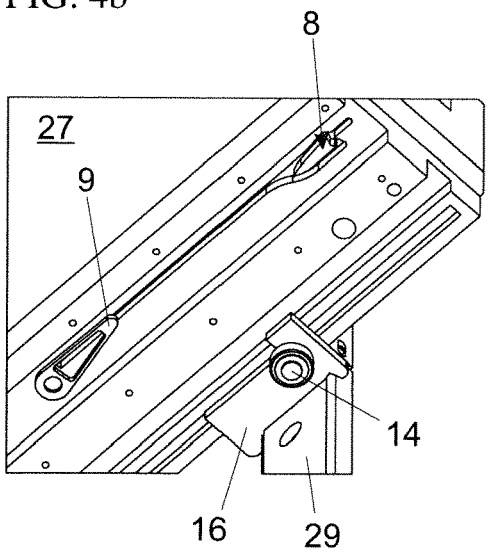
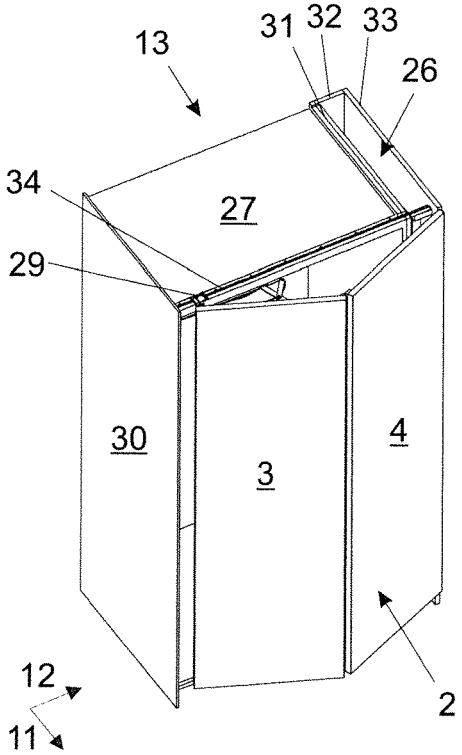
FIG. 4c

FIG. 5a
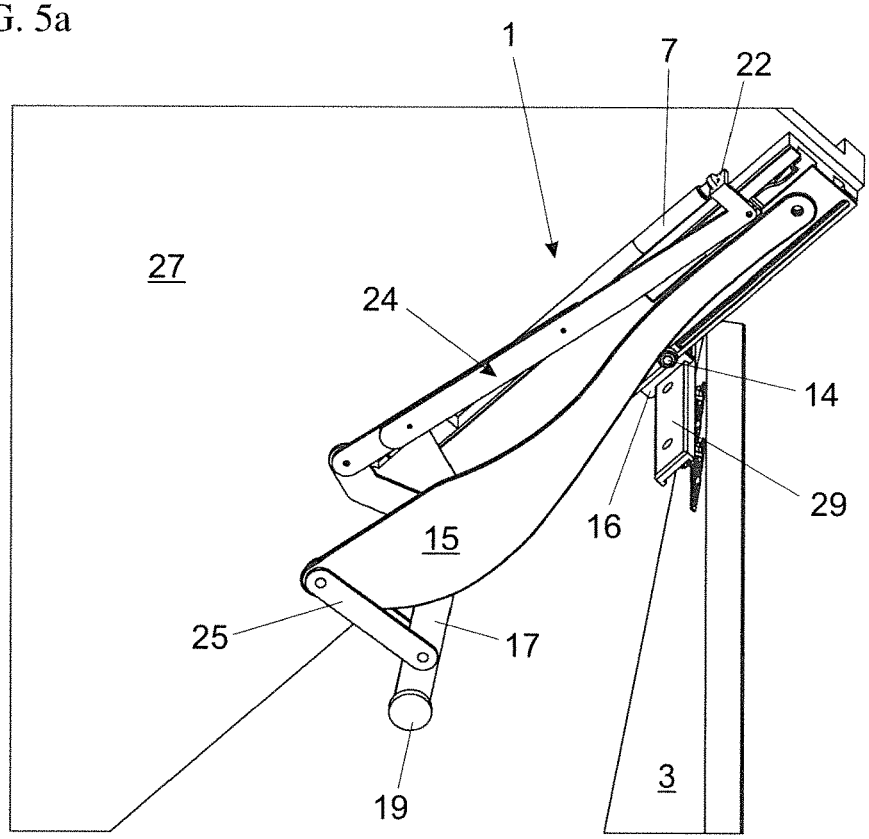
FIG. 5b
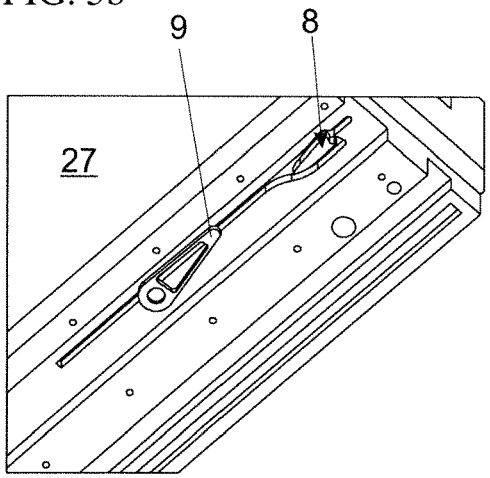
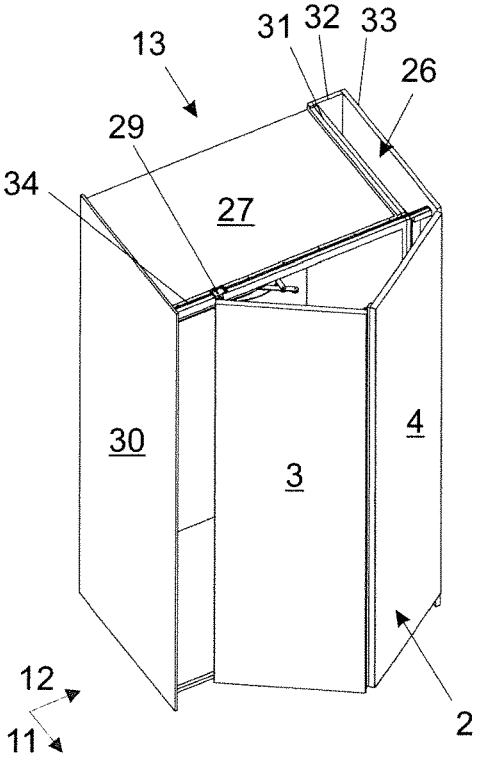
FIG. 5c

FIG. 6a
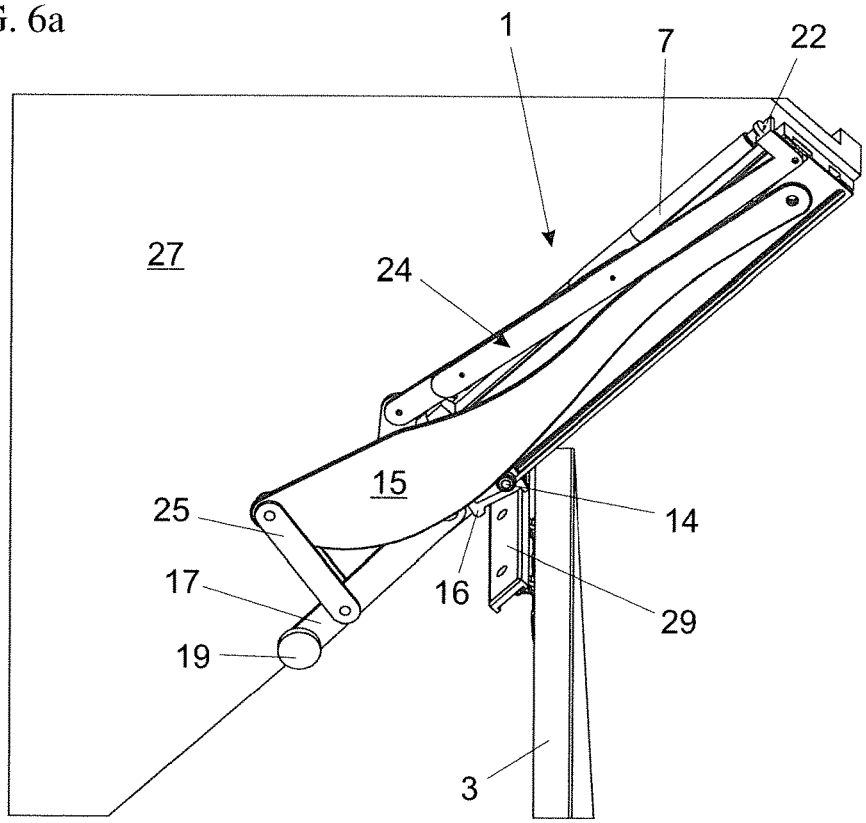
FIG. 6b
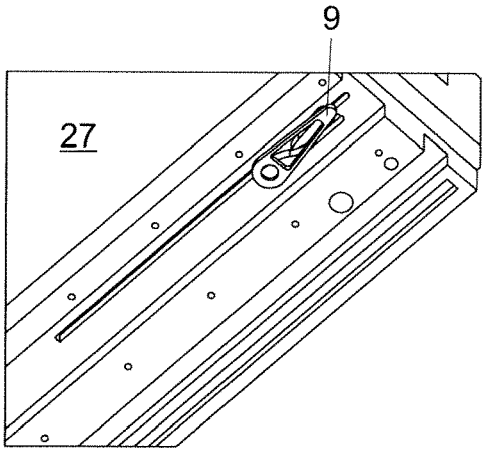
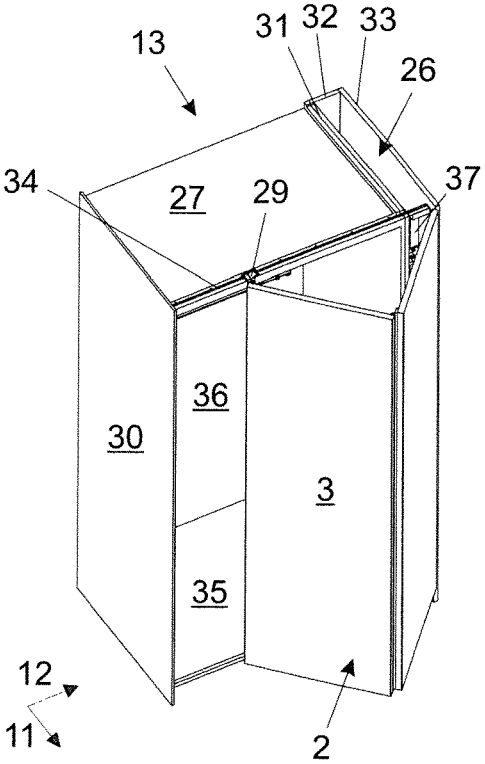
FIG. 6c

FIG. 7a
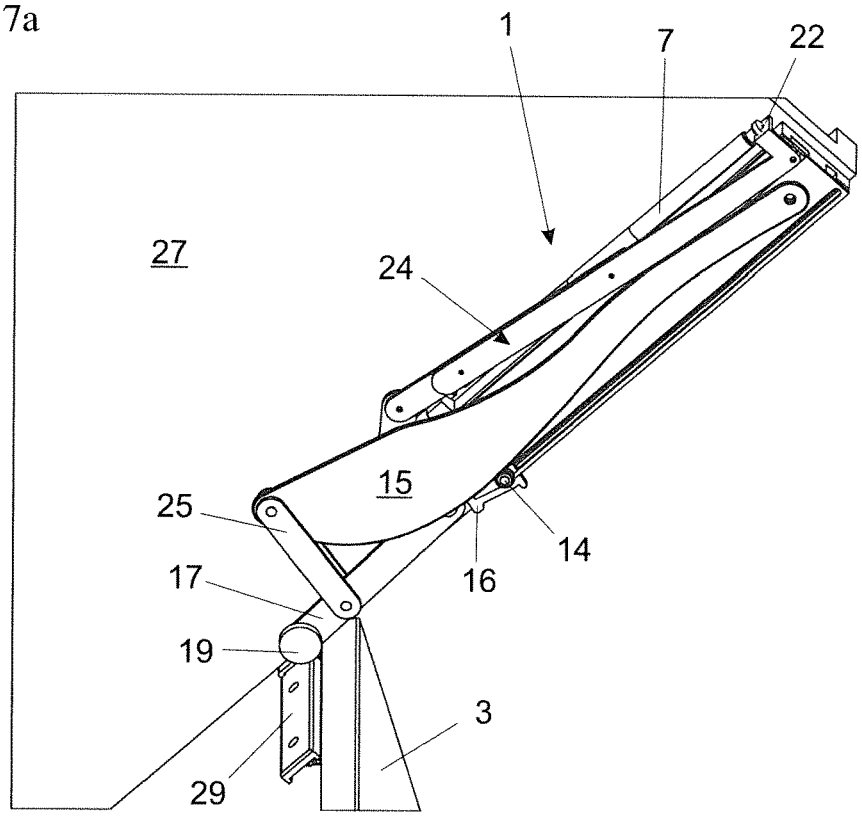
FIG. 7b
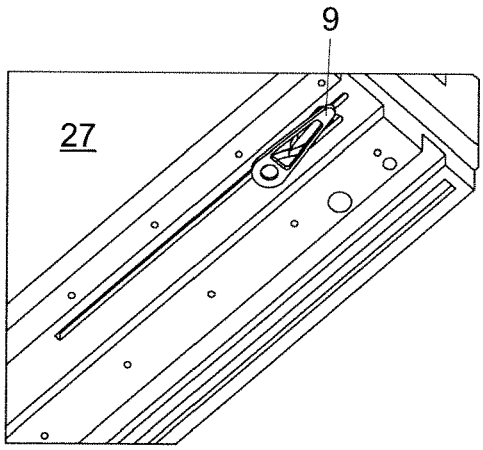
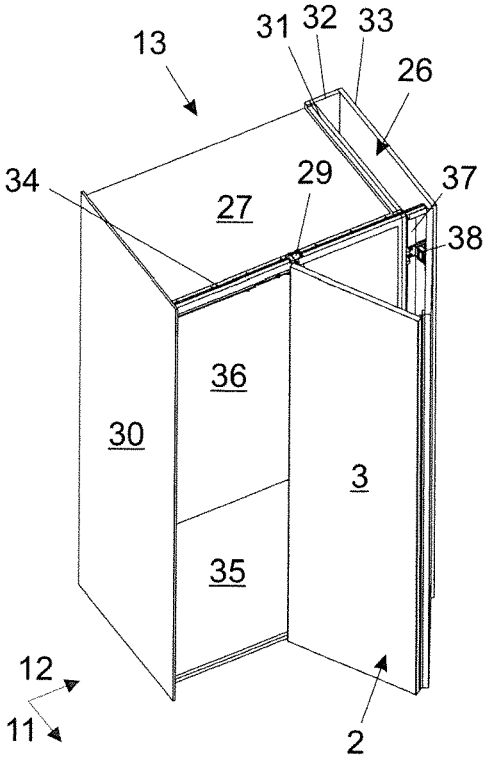
FIG. 7c

FIG. 8a
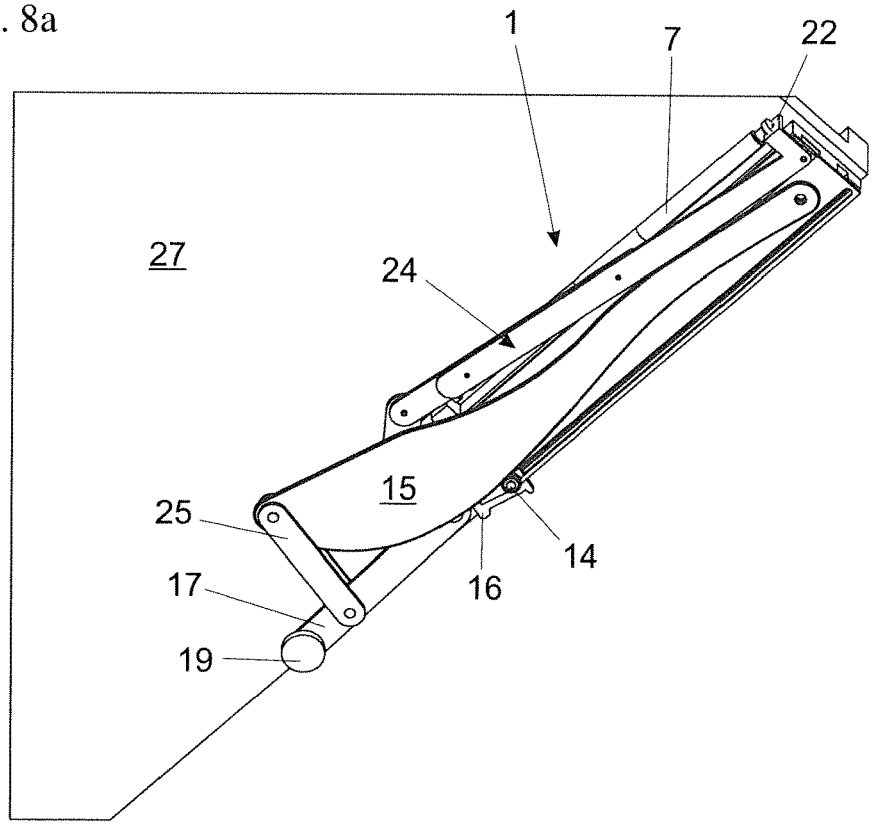
FIG. 8b
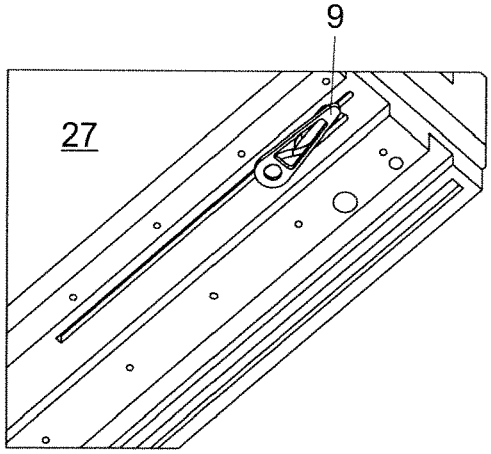
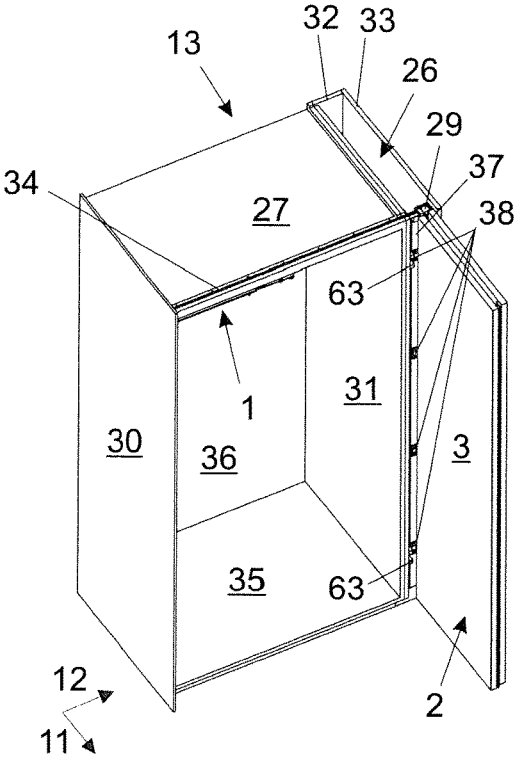
FIG. 8c

FIG. 9a
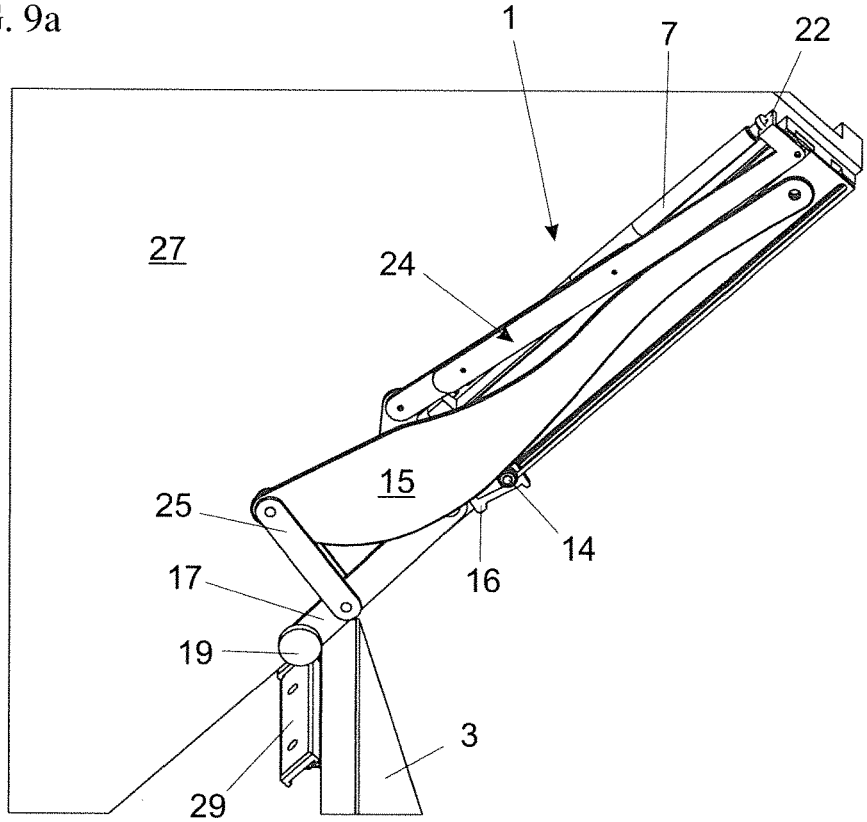
FIG. 9b
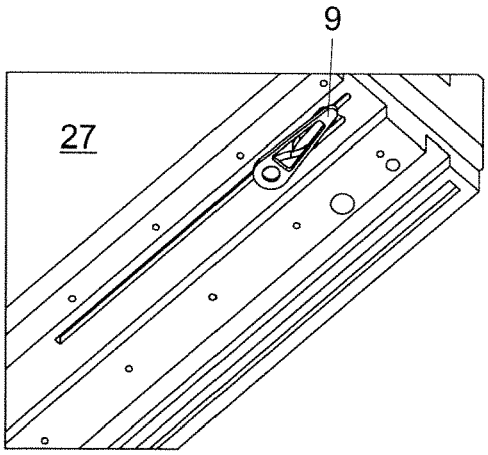
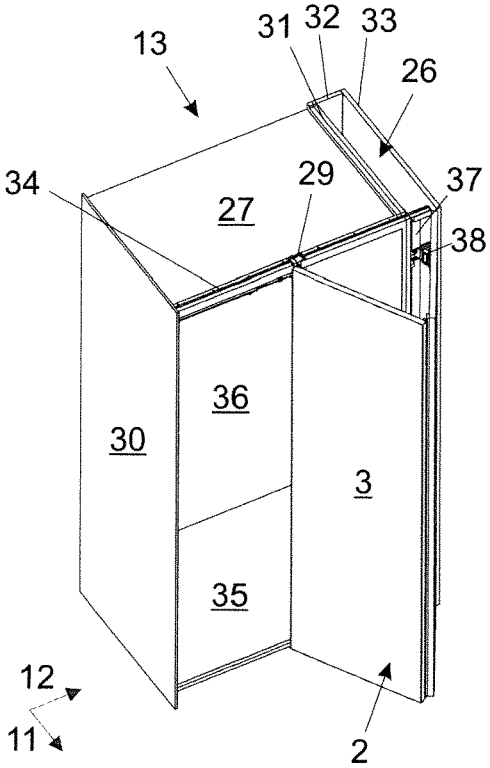
FIG. 9c

FIG. 10a
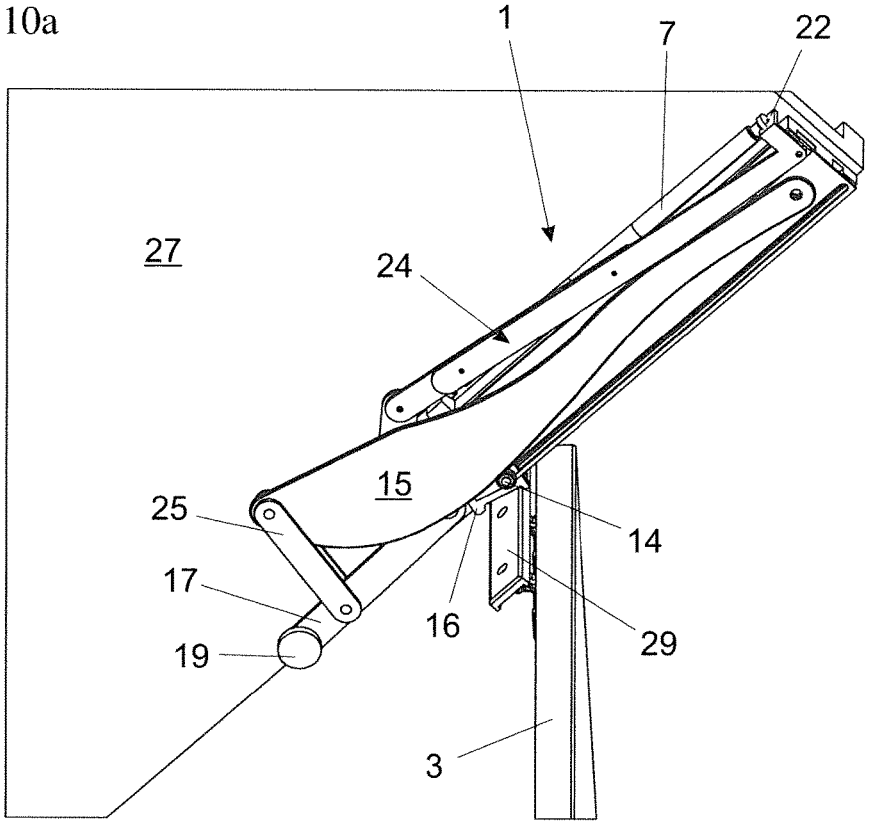
FIG. 10b
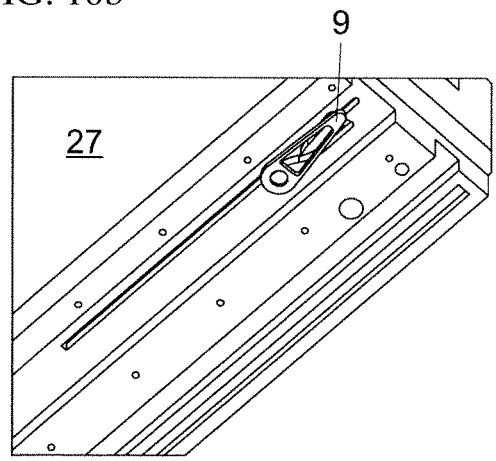
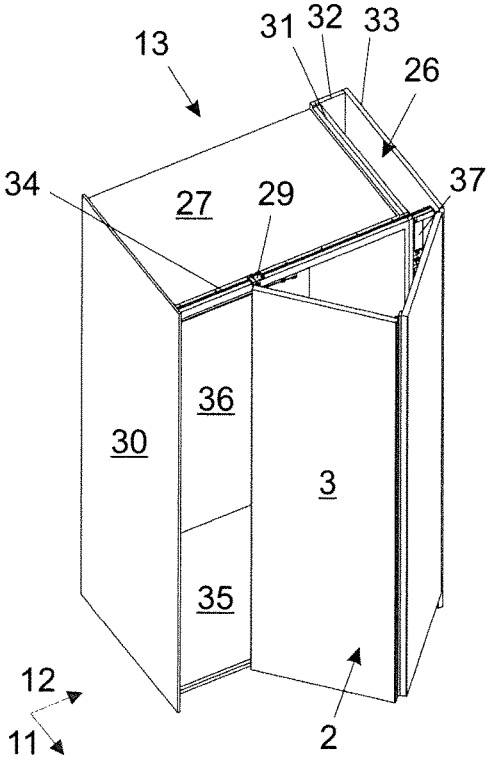
FIG. 10c

FIG. 11a
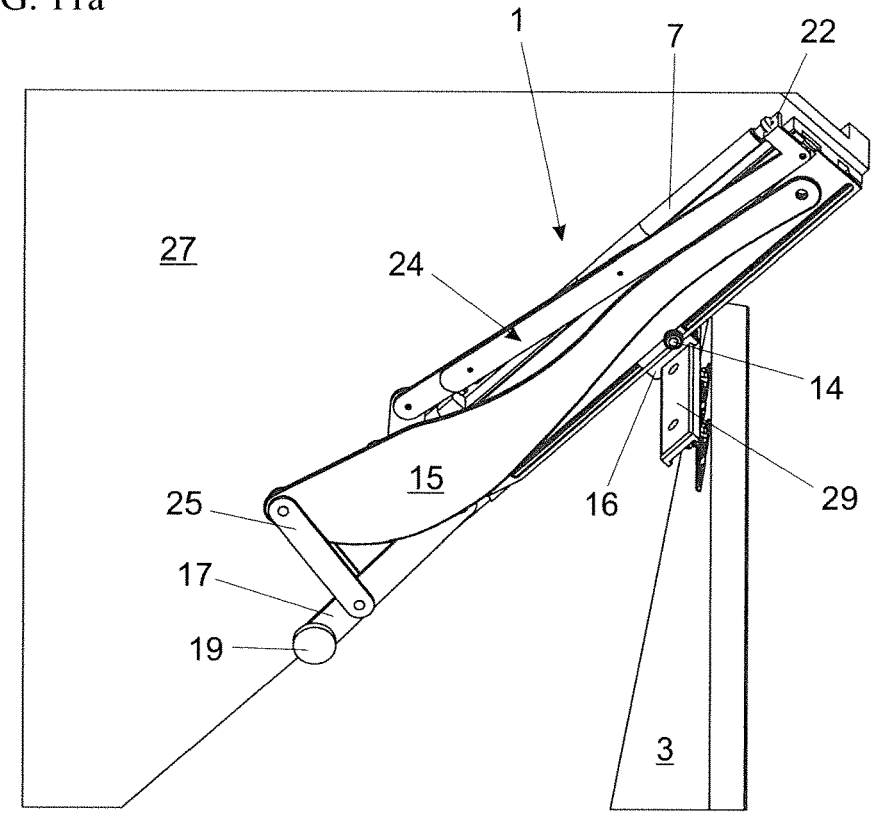
FIG. 11b
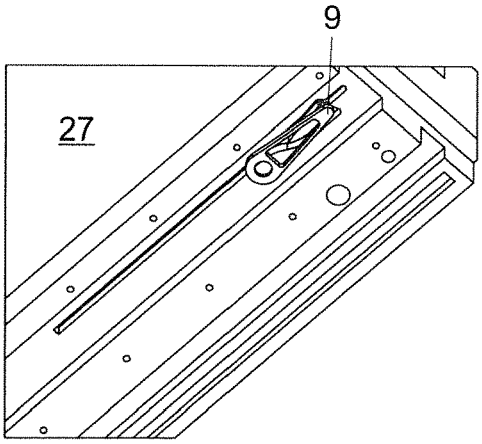
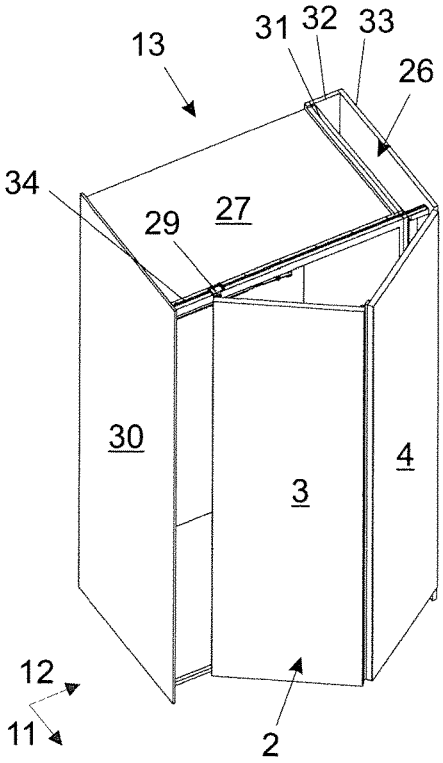
FIG. 11c

FIG. 12a
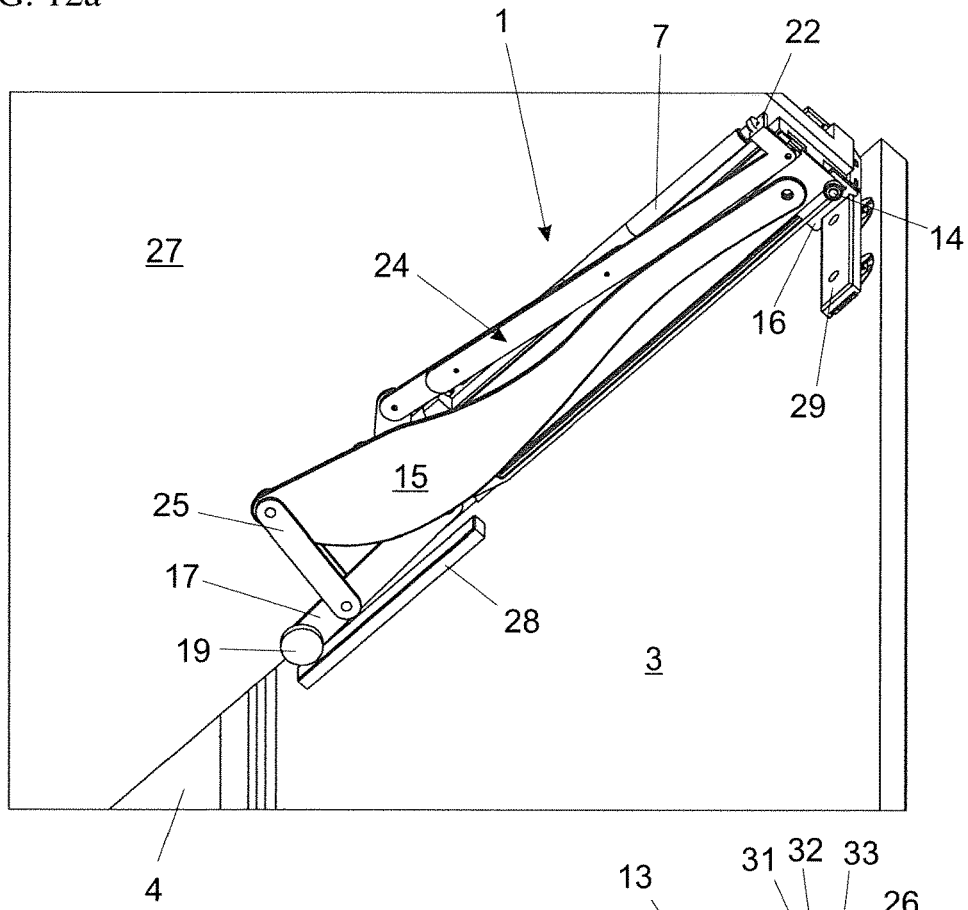
FIG. 12b
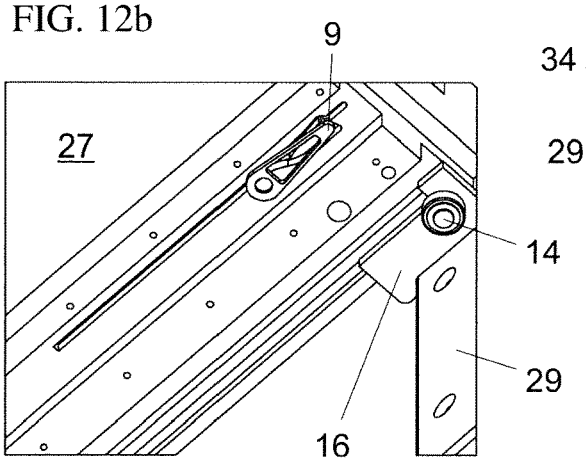
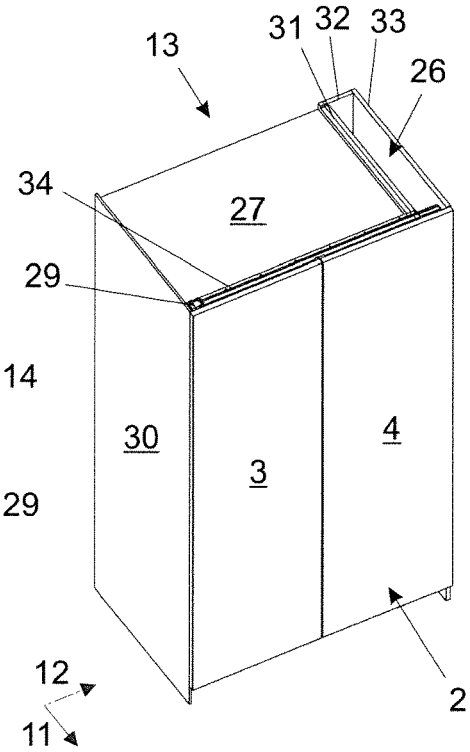
FIG. 12c

EJECTING DEVICE AND ARRANGEMENT CONSISTING OF A PIECE OF FURNITURE AND AN EJECTING DEVICE

BACKGROUND OF THE INVENTION

The invention concerns an ejection device for ejecting a folding-sliding door mounted movably to an article of furniture from a closed position into an open position, and the folding-sliding door is movable at least in a direction perpendicular to the closing plane in which the folding-sliding door is arranged in its closed position and in a direction parallel to the closing plane. The invention also concerns an arrangement comprising an article of furniture, a folding-sliding door mounted movably to the article of furniture, and an ejection device according to the invention.

Ejection devices are known from DE 91 05 187 U1. A disadvantage in that respect is that this involves technically complicated and expensive solutions which are thus susceptible to trouble and costly and which for example require the provision of an electric motor.

SUMMARY OF THE INVENTION

Therefore the object of the present invention, while avoiding the disadvantages known from the state of the art, is to provide an improved ejection device which in particular is technically uncomplicated and inexpensive.

Therefore, the ejection device includes a force storage member to be loaded manually by a user and an ejection element which can be acted upon by the force storage member, and the force storage member can be loaded by a sliding movement of the folding-sliding door substantially in the direction parallel to the closing plane, preferably in the course of continued opening of the folding-sliding door following the ejection, particularly preferably immediately.

The ejection device has a locking device for releasably locking the ejection element against the force applied by the loaded force storage member, and the locking device can be unlocked when the ejection device is fitted in place by applying pressure to the folding-sliding door.

Alternatively or supplemental thereto, a further development provides that the folding-sliding door includes at least two hingedly interconnected portions, the portions can be foldably opened by the ejection element from the closed position in which they are arranged in a common closing plane into an open position in which they include an angle different from 180° relative to each other, and the opening folding movement is effected substantially in the direction perpendicular to the closing plane.

If a locking device is provided and if the folding-sliding door includes at least two hingedly interconnected portions, a further structure provides that the locking device is unlockable by applying pressure to the folding-sliding door in the region in which the at least two portions are hingedly interconnected.

As stated in the opening part of this specification, an arrangement includes a furniture body of an article of furniture, a folding-sliding door mounted movably to the furniture body, and an ejection device according to the invention.

In that case, advantageously the furniture body has an in particular shaft-shaped cavity for receiving the folding-sliding door and the arrangement preferably has a particularly preferably mechanical drive device for moving the folding-sliding door between a position of being retracted in the cavity and a position outside the cavity. It should be mentioned that the retracted position in the cavity preferably involves a completely retracted position in the cavity. Moving the folding-sliding door into and out of the cavity is significantly facilitated by the provision of the drive device.

It has also proven to be particularly advantageous if the ejection device is adapted to move the folding-sliding door upon opening folding movement or ejection thereof at least partially in the direction of the in particular shaft-shaped cavity.

For the situation where the folding-sliding door includes at least two hingedly interconnected door leaves and the door leaves can assume a folded-together position and a spread-open position, handling of the arrangement can further be facilitated for a user in that the arrangement includes a spreading device for spreading the door leaves or the portions from the folded-together position into the spread-open position.

And finally, there are provided one or more damping devices for damping the movement of the folding-sliding door directly before reaching one or more defined positions relative to the furniture body. Those defined positions relative to the furniture body can involve:

- the closed position in which the at least two door leaves of the folding-sliding door are arranged in a common closing plane,
- the open position in which the at least two door leaves of the folding-sliding door include an angle different from 180° relative to each other,
- the completely opened position of the folding-sliding door in which the interior of the furniture body is freely accessible, and/or
- for the situation where the furniture body has an in particular shaft-shaped cavity for receiving the folding-sliding door, the position outside the cavity and/or the retracted position in the cavity, wherein the interior of the article of furniture is also freely accessible in those positions.

BRIEF DESCRIPTION OF THE DRAWINGS

Further advantages and details of the invention will be apparent from the drawings, in which:

FIGS. 1*a* through 12*c* illustrate the mode of operation of the ejection device in accordance with a particularly preferred embodiment of the invention, with FIGS. 1*a*, 1*b*, 2*a*, 2*b*, 3*a*, 3*b*, 4*a*, 4*b*, 5*a*, 5*b*, 6*a*, 6*b*, 7*a*, 7*b*, 8*a*, 8*b*, 9*a*, 9*b*, 10*a*, 10*b*, 11*a*, 11 *b*, 12*a*, and 12*b* each showing a view of the ejection device looking from the interior of the article of furniture, in which a series of components of the ejection device have been omitted in FIGS. 1*b*, 2*b*, 3*b*, 4*b*, 5*b*, 6*b*, 7*b*, 8*b*, 9*b*, 10*b*, 11 *b*, and 12*b* to give a clear view of the locking device, and FIGS. 1*c*, 2*c*, 3*c*, 4*c*, 5*c*, 6*c*, 7*c*, 8*c*, 9*c*, 10*c*, 11*c*, and 12*c* each show a complete article of furniture with a folding-sliding door.

DETAILED DESCRIPTION OF THE INVENTION

Figure 13:
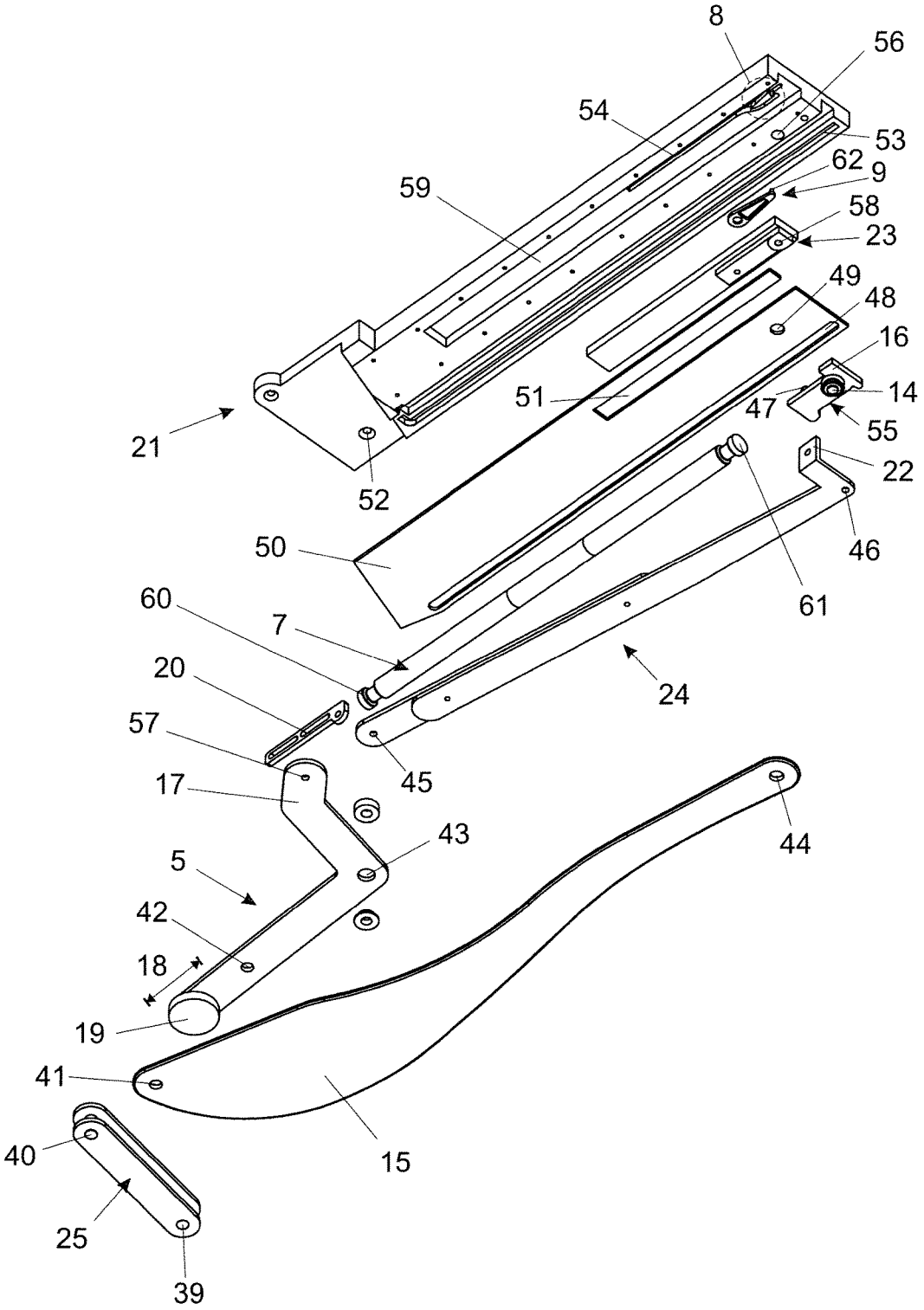
FIG. 13 shows an exploded view of the ejection device.

The basic structure of the ejection device according to the particularly preferred embodiment of the invention can be understood by reference to that exploded view:

The ejection device (provided with reference numeral 1 in the other Figures) includes a base element 21 which can be arranged stationarily on a carcass (furniture body) of an article of furniture.

As illustrated in FIG. 13, base element 21 has a plurality of guide tracks 53, 54 and 59. In that respect, the guide track 53 is provided for guiding a stud 47 arranged on an entrainment member 16, the guide track 54 serves for guiding a pin 62 arranged on a locking element 9, and the guide track 59 is provided for guiding a slider 23 on which the locking element 9 is pivotably arranged. It should also be noted that the guide track 54 includes a cardiod curve-shaped locking contour 8 against which the locking element 9 or the pin 62 of that locking element can be supported.

The base element 21 can be provided with a cover 50, that cover serving to hold the slider 23 and the entrainment member 16. The guide tracks 48 and 51 provided in the cover 50 ensure that the entrainment member 16 and the slider 23 respectively are substantially linearly displaceable with respect to the base element 21.

The ejection device further includes a force storage member 7 in the form of a traction spring having a first end 60 and a second end 61. In this case, the first end 60 is stationarily connected (fixed) to the base element 21 by an intermediate element 20. The second end 61 of the spring is connected to a spring holder 22 movable relative to the base element 21. The movable spring holder 22 is provided on an intermediate lever 24 which on the one hand is mounted pivotably to the slider 23 (for that purpose, suitable fixing locations 46 and 58 are provided on the intermediate lever 24 and the slider 23). On the other hand, the intermediate lever 24 is connected pivotably to an ejection element 5 by fixing locations 45 and 57, wherein the fixing location 45 is provided on the intermediate lever 24 and the fixing location 57 on the ejection element 5.

The ejection element 5 has a lever 17 having a free lever end 18 at which a rotatably mounted rolling body 19 is arranged for contacting the folding-sliding door or an element connected thereto, at least in the opening folding movement. The lever 17 is connected pivotably to the base element 21 (for that purpose, fixing locations 43 and 52 are provided on the lever 17 and on the base element 21).

The ejection device further also includes a loading device for loading the force storage member 7. Essential components of that loading device are a control contour 15 which on the one hand is connected pivotably by a force transmission element 25 to the ejection element 5. For that purpose, the lever 17 of the ejection element 5 has a fixing location 42, the control contour 15 has a fixing location 41 and the force transmission element 25 has fixing locations 39 and 40. On the other hand the control contour is mounted pivotably to the base element 21. For that purpose, a fixing location 44 is provided on the control contour 15 and a fixing location 56 is provided on the base element 21. Fixing means which ensure pivotal mounting can pass through an opening 49 in the cover 50. An essential component of the loading device is further a control element 14 which is in the form of a rolling body and is arranged on the entrainment member 16. The control element 14 is guided displaceably in the guide track 48 of the cover 50.

With regard to the entrainment member 16, it should also be noted that it motionally couples the folding-sliding door to the loading device at least upon loading of the force storage member 7, and has a recess 55 for temporarily receiving a portion of a carriage 29 connected to the folding-sliding door (see for example FIG. 1*a*).

With reference to FIGS. 1 through 12 the mode of operation of the ejection device 1 will now be discussed in detail:

FIG. 1*a* through 1*c* relate to the closed position of a cover element 2 mounted movably to a furniture body of an article of furniture 13, in the form of a folding-sliding door including two hingedly interconnected door leaves 3 and 4. In that closed position, the two door leaves 3 and 4 are disposed in a common closing plane. In addition in that closed position, the folding-sliding door closes off the interior of the article of furniture 13.

The article of furniture 13 includes a furniture carcass (furniture body) formed from a top panel 27, a bottom panel 35, a rear wall 36 and a plurality of side walls 30, 31 and 33 which are arranged substantially parallel to each other and spaced from each other (see also the other sub-Figures c of FIGS. 1 through 12). The article of furniture 13 further includes a shaft-shaped cavity 26 for receiving the folding-sliding door 2, that cavity being defined by boundary surfaces in the form of two side walls 31 and 33 and in the form of a portion 32 of the rear wall 36 of the article of furniture 13.

FIG. 1*a* shows the ejection device 1 for the folding-sliding door in that closed position of the folding-sliding door and FIG. 1*b* shows a part of the ejection device, namely the locking device for releasably locking the ejection element in the form of the cardioid curve-shaped locking contour 8 and the locking element 9 which can be supported against the locking contour 8. Stated more precisely, the locking element 9 is a pivot lever, at the free end of which is arranged a pin 62 which in the closed position of the folding-sliding door is arranged in the recess of the cardioid curve 8. The locking element 9 is mounted pivotably to the slider 23 which in turn is connected to the movably mounted end 61 of the spring 7 by the intermediate lever 24 which includes the movable spring holder 22. In the closed position of the folding-sliding door, the force storage member 7 or the spring is loaded. This means that the locking device, in that state, ensures that the energy stored in the force storage means cannot become free.

Unlocking of the locking device is effected by applying pressure to the folding-sliding door 2 in the region 10 in which the two door leaves 3 and 4 are hingedly interconnected. In that case, the folding-sliding door 2 is moved out of the closed position into an over-pressed position which is behind the closed position. That over-pressed position is shown in FIGS. 2*a* through 2*c*.

If FIG. 1*b* and 2*b* are compared, it becomes apparent that, in the transition from the closed position into the over-pressed position, the control pin 62 is moved out of the recess in the cardioid curve-shaped locking contour 8, more specifically in such a way that, when the folding-sliding door 2 is released, the energy stored in the force storage member 7 can become free. In that case, the tension spring 7 contracts, in other words the movably mounted end 61 of the spring moves towards the stationarily arranged end 60 of the spring. In that case, the movable spring holder 22 and therewith the entire intermediate lever 24 is also moved in positively guided relationship, positive guidance being effected by the slider 23 and the guide tracks 54, 59 and 61.

The movement of the intermediate lever 24 is converted into a pivotal movement of the ejection element 5, more precisely the lever 17, as a comparison of FIGS. 2*a* and 3*a* shows. FIGS. 3*a* through 3*c* relate to the position of the ejection device 1 in which the force storage member 7 is substantially completely unloaded.

The pivotal movement of the lever 17 is converted into an opening folding movement of the folding sliding door 2 by the rolling body 19 mounted rotatably at the free end 18 of the lever 17. In that case, the rolling body 19 is supported against a running contour 28 arranged on the folding-sliding door.

As a comparison of FIGS. 2*c* and 3*c* shows, the folding-sliding door 2 was moved by the ejection device in the course of the opening folding movement from the closed position, in which the two door leaves 3 and 4 are disposed in a common closing plane, into an open position, in which the two door leaves 3 and 4 include an angle 6 different from 180° relative to each other. The opening folding movement was thus effected substantially in a direction 11 perpendicular to the closing plane.

It can be seen from FIG. 3*b* that the control pin 62 on the locking element 9, in the unloaded state of the force storage member 7, has reached the end of the guide track 54 opposite to the cardioid-shaped locking contour 8.

Finally, it should also be noted that the ejection device 1, in the folding opening movement, has also moved the folding-sliding door 2 in a direction 12 parallel to the closing plane, more precisely in the direction of the shaft-shaped cavity 26. In that case, the carriage 29 on which the door leaf 3 is pivotably mounted has moved a distance along a guide device 34 arranged on the top panel 26 of the article of furniture 13. That guide device 34 is of such a configuration that the carriage 29 can be displaced as smoothly as possible.

By virtue of its inertia, following the opening folding movement implemented by the ejection device 1, the folding-sliding door 2 moves still somewhat further, even if the force storage member 7 is already unloaded. In that case, the door leaf 3 of the folding-sliding door 2 lifts off the rolling body 19. At the same time, the angle 6 which the two door leaves 3 and 4 include relative to each other is also further reduced. When the energy has been dissipated, the folding-sliding door 2 comes to a stop. In that case, it assumes approximately a position as shown in FIGS. 4*a* through 4*c*.

Apart from the fact that the rolling body 19 is no longer in contact with the running contour 28, a comparison between FIGS. 3*a* and 4*a* shows that the carriage 29 has moved still further in the direction 12 parallel to the closing plane and still further in the direction of the shaft-shaped cavity 26.

In the region of the carriage 29 in which the carriage 29 is coupled to the folding-sliding door 2, the carriage 29 is coupled to the entrainment member 16. The entrainment member 16 has the recess 55 for the purposes of that temporary coupling. The entrainment member 16 is also moved in a positively guided relationship in the direction 12 parallel to the closing plane and in the direction of the shaft-shaped cavity 26 by virtue of the motional coupling, and in this case positive guidance is implemented by the guide tracks 53 and 48 (see FIG. 13). In the position in FIG. 4*a*, the entrainment member 16 in this case has reached a position in which the control element 14 arranged on the entrainment member 16, in the form of the rolling body, contacts for the first time the control contour 15 of the loading device for loading the force storage member 7.

A user now intervenes for further opening of the folding-sliding door 2, preferably by gripping behind the free edge of the door leaf 3 and exerting a force in the direction of the shaft-shaped cavity 26, that is to say in the direction 12 parallel to the closing plane of the folding-sliding door 2. In that case, the folding-sliding door 2 is moved beyond the intermediate positions shown in FIGS. 5, 6 and 7 into a folded-together position (see FIG. 8).

A part of the energy transmitted to the folding-sliding door 2 by the user is in that case used for loading the force storage member 7, more specifically in the course of continued opening of the folding-sliding door 2, which directly follows the opening folding movement.

In detail, the force storage member 7 is loaded by the entrainment member 16 being moved in the direction 12 parallel to the closing plane or in the direction of the shaft-shaped cavity 26 by the coupling to the carriage 29. That movement is converted by the rolling body 14 on the entrainment member 16 into a pivotal movement of the control contour 15 which, in turn, moves the lever 17 of the ejection element 5 by the force transmission element 25. Thus, the intermediate lever 24 is moved back into the original closed position shown in FIG. 1 again. In that case, the spring 7 is drawn apart, that is to say energy is transmitted to the force storage member 7.

The control contour 15 has such a configuration that the user initially experiences a slight resistance and that resistance then increases. That is advantageous as generally the user has to first accelerate the folding-sliding door 2 out of the stopped condition.

FIGS. 5*a* through 5*c* show an intermediate position during loading of the force storage means 7.

FIGS. 6*a* through 6*c* show the state of the ejection device 1 in which the force storage member 7 is again completely loaded. In this state, the control pin 62 on the locking element 9 is again disposed in the recess in the cardiod curve-shaped locking contour 8. In other words, the ejection element 5 is again locked by the locking device against the force applied by the loaded force storage member 7.

Upon termination of the loading process, the entrainment member 16 pivots. For that purpose, there is provided a curved portion in the guide track 53. By virtue of the pivotal movement, the motional coupling to the folding-sliding door 2 or the carriage 29 is nullified. The folding-sliding door 2 can now be further moved into the folded-together position shown in FIG. 8*c* unimpededly by way of the intermediate position shown in FIGS. 7*a* through 7*c*. In that case, the ejection device 1 remains in the position shown in FIGS. 6*a* through 6*c*.

Starting from that folded-together position, it is now possible for the user to stow the folding-sliding door 2 in the cavity 26. For that purpose, the user exerts a force on the folding-sliding door 2 in the folded-together position, that is to say on the door pack assembly in the direction of the rear wall 36 of the article of furniture 13. In that case, the door leaf 4 of the folding-sliding door 2 is preferably arranged by hinges 38 on a carrier element 37 which, in turn, is mounted displaceably in the longitudinal direction of the shaft cavity 26 by guide elements 63 arranged on the side wall 31.

To support the movement of the folding-sliding door 2 out of a preferably completely retracted position in the cavity 26 into the position outside the cavity, a drive device can be provided to, after initialization by a user, automatically move the folding-sliding door 2 out of the cavity 26.

In addition, a spreading device can be provided for spreading open the door leaves 3 and 4 from the folded-together position into the spread-open position, the spreading device becoming operative immediately after the position outside the cavity 26 is reached as shown in FIG. 8*c* so that the folding-sliding door 2 is not only moved automatically out of the cavity 26 but is then also moved into a slightly spread position so that a user has a better option of gripping the door in order to move the folding-sliding door 2 again into its closed position in which the two door leaves 3 and 4 are disposed in the common closing plane.

The transition into the closed position, starting from the completely opened position as shown in FIGS. 8*a* through 8*c*, is shown in FIGS. 9 through 12, wherein FIG. 12 again shows the closed position which is also illustrated in FIG. 1.

Firstly, the folding-sliding door 2 or the carriage 29 is moved in the direction 12 parallel to the closing plane, but this time away from the cavity 26, more specifically until the carriage 29 contacts the entrainment member 16 (see FIG. 10). Until then, nothing has changed in the position of the ejection device 1.

Now, as a comparison of FIGS. 10 and 11 shows, the entrainment member 16 is entrained by the carriage 29, more specifically until it has again reached its original position. That does not change anything in terms of the position of the other parts of the ejection device 1.

The invention claimed is:

1. An arrangement comprising:

a furniture body;

a folding-sliding door movably mounted to said furniture body; and an ejection device for ejecting said folding-sliding door from a closed position into an opening position, said folding-sliding door being arranged within a closing plane when in the closed position, said ejection device including:

a force storage member configured to be loaded manually by a user;

an ejection element to be acted upon by said force storage member;

a loading device for loading said force storage member; and an entrainment member for motionally coupling said folding-sliding door to said loading device during loading of said force storage member, said entrainment member being displaceable parallel to the closing plane;

wherein said folding-sliding door is configured and mounted to be movable in a direction perpendicular to the closing plane and in a direction parallel to the closing plane, wherein said force storage member is configured to be loaded by a sliding movement of said folding-sliding door in the direction parallel to the closing plane during continued opening of said folding-sliding door following ejection of said folding-sliding door into the opening position.

2. The arrangement as set forth in claim 1, wherein said ejection device includes a locking device configured to releasably lock said ejection element against a force applied by said force storage member, and configured to unlock said ejection element by applying pressure to said folding-sliding door.

3. The arrangement as set forth in claim 2, wherein said folding-sliding door includes at least two hingedly interconnected portions, said locking device being configured to unlock said ejection element by applying pressure to said folding-sliding door in a region in which said at least two portions are hingedly interconnected.

4. The arrangement as set forth in claim 1, wherein said folding-sliding door includes at least two hingedly interconnected portions both arranged within the closing plane when said folding-sliding door is in the closed position, said at least two hingedly interconnected portions being configured to be foldably opened by said ejection element from the closed position into a fully open position in which they are arranged at an angle of 180° relative to each other, and an opening folding movement of said at least two hingedly interconnected portions is effected substantially in the direction perpendicular to the closing plane.

5. The arrangement as set forth in claim 1, wherein said loading device includes a control element arranged on said entrainment member, and a control contour against which said control element bears during loading of said force storage member.

6. The arrangement as set forth in claim 5, wherein said control element is formed as a rolling body.

7. The arrangement as set forth in claim 1, wherein said ejection element includes a pivotably mounted lever having a free lever end for contacting said folding-sliding door during at least one of the ejecting and the continued opening of said folding-sliding door.

8. The arrangement as set forth in claim 7, wherein said pivotably mounted lever includes a rotatably mounted rolling body at the free lever end.

9. The arrangement as set forth in claim 1, wherein said force storage member includes a spring arranged between a fixed spring holder and a movable spring holder movable relative to said fixed spring holder.

10. The arrangement as set forth in claim 9, wherein said ejection device includes a locking device configured to releasably lock said ejection element against a force applied by said force storage member, and said movable spring holder is connected to at least one of:

said locking device by a slider;

said ejection element by an intermediate lever; and/or said loading device by a force transmission element.

11. The arrangement as set forth in claim 1, wherein said ejection device includes a locking device configured to releasably lock said ejection element against a force applied by said force storage member, said locking device having a cardioid curve-shaped locking contour against which a locking element is to be supported.

12. The arrangement as set forth in claim 1, wherein said furniture body has a cavity for receiving said folding-sliding door.

13. The arrangement as set forth in claim 12, further comprising a mechanical drive device for moving said folding-sliding door between a retracted position within said cavity and an extended position outside said cavity.

14. The arrangement as set forth in claim 12, wherein said ejection device is configured to move said folding-sliding door during at least one of the ejecting and the continued opening of said folding-sliding door at least partially toward said cavity.

15. The arrangement as set forth in claim 1, wherein said folding-sliding door includes at least two hingedly interconnected portions configured to assume a folded-together position and a spread-open position, said arrangement further comprising a spreading device for spreading said at least two hingedly interconnected portions from the folded-together position into the spread-open position.

16. The arrangement as set forth in claim 1, further comprising a damping device for damping a movement of said folding-sliding door directly before reaching one or more defined positions relative to said furniture body.

17. The arrangement as set forth in claim 1, wherein said force storage member is configured to be loaded by a sliding movement of said folding-sliding door in the direction parallel to the closing plane during continued opening of said folding-sliding door immediately following ejection of said folding-sliding door into the opening position.

18. The arrangement as set forth in claim 1, wherein said folding-sliding door includes a first portion and a second portion hingedly interconnected, said first portion including a carriage fixed to a distal end thereof, said distal end being opposite to a proximate end hingedly connected to said second portion, said carriage being configured to engage and disengage said entrainment member as said carriage moves along the closing plane during the ejecting and the continued opening of said folding-sliding door.

* * * * *